United States Patent [19]

Stevenson

[11] Patent Number: 4,549,886

[45] Date of Patent: Oct. 29, 1985

[54] OPERATION OF GAS GENERATOR

[75] Inventor: John S. Stevenson, Los Angeles, Calif.

[73] Assignee: Texaco Inc., White Plains, N.Y.

[21] Appl. No.: 595,101

[22] Filed: Mar. 30, 1984

[51] Int. Cl.[4] ..... C10J 3/46

[52] U.S. Cl. ..... 48/197 R; 48/206; 48/215; 48/DIG. 10; 252/373

[58] Field of Search ..... 48/197 R, 215, DIG. 10, 48/206; 252/373

[56] References Cited

U.S. PATENT DOCUMENTS

| | | | |
|---|---|---|---|
| 3,743,606 | 7/1973 | Marion et al. | 48/215 |
| 3,847,564 | 11/1974 | Marion et al. | 48/215 |
| 4,338,099 | 7/1982 | Crouch et al. | 48/215 |
| 4,392,869 | 7/1983 | Marion et al. | 48/DIG. 10 |

*Primary Examiner*—Peter Kratz

*Attorney, Agent, or Firm*—Robert A. Kulason; James J. O'Loughlin; Albert Brent

[57] ABSTRACT

A method is provided for turning down or up the output of raw product gas from a partial oxidation gas generator while maintaining in an acceptable range the efficiency of the gas generation, or conversion of the fuel to gas, and the quality of the gas produced. In the process, the flow rates for the separate feedstreams to the burner comprising fuel optionally in admixture with a temperature moderator, at least one stream of free-oxygen containing gas optionally in admixture with a temperature moderator, and with or without a separate feedstream of temperature moderator are adjusted down or up a predetermined amount to obtain a specified output of raw product gas while maintaining substantially constant in the reaction zone the levels of O/C atomic ratio and the temperature moderator/fuel weight ratio. Further, the temperature of at least one stream of free-oxygen containing gas optionally in admixture with a temperature moderator is increased at turn-down and decreased at turn-up to a predetermined value which is an indirect function of its adjusted flow rate. By this means, the burner tip velocity of the temperature adjusted stream of free-oxygen containing gas optionally in admixture with a temperature moderator is held within an acceptable range, and changes in the process efficiency and pressure drop across the burner are minimized.

28 Claims, No Drawings

OPERATION OF GAS GENERATOR

BACKGROUND OF THE INVENTION

This invention relates to the partial oxidation process. More specifically it relates to a method for turning down or up a free-flow partial oxidation gas generator for the production of synthesis gas, reducing gas, or fuel gas.

The manufacture of gaseous mixtures comprising $H_2$ and CO by the partial oxidation process is well known. Further, it is the preferred procedure for many fossil fuels, e.g., petroleum oil and coal. Synthesis gas made by this process is now widely used for the catalytic synthesis of such chemicals as ammonia, methanol and acetic acid. Coal gasification by partial oxidation for the production of fuel gas which is burned in gas turbines for power generation is an acceptable alternative for nuclear energy and oil over the next term.

When the demand for feed gas to supply a chemical plant or an electrical generating station associated with a gas generating system decreases, the gas generator may have to operate at a fraction of the design feed rate so as to deliver a corresponding smaller amount of gas. When this occurs, performance of the system drops since the gas generator and related equipment, such as burners for introducing the feedstreams into the gas generator, are designed to operate at specific conditions, e.g., pressure, residence time, velocities and pressure drops for the design output. It was unexpectedly found that by operating the partial oxidation process in the manner specified herein, one can avoid the deleterious effects of the changes that would normally occur with a change in the flow rates of the feedstreams to the gasifier. High performance is assured over a wide operating range.

SUMMARY OF THE INVENTION

This is an improved partial oxidation process for the production of synthesis gas, reducing gas, or fuel gas in which the rates of flow of the feedstreams to the gas generator are adjusted down or up by a specified percentage of the design flow rate, thereby turning down or up respectively, the output of the raw product gas. Although there is a change from the design flow rates, unexpectedly in the subject process system performance remains high.

In the process for a specified output of product gas, the flow rate for each of the feedstreams to the burner is adjusted down or up a predetermined amount, for example to a value within the range of about 18 to 225%, such as about 25 to 140% of its design flow rate, while maintaining substantially constant the O/C atomic ratio and the temperature moderator/fuel weight ratio. By definition, the design flow rate for a feedstream is the flow rate for which the burner was originally sized to handle.

Further, during turndown or turnup, while maintaining substantially constant the O/C atomic ratio and the temperature moderator/fuel weight ratio, the temperature of at least one of the oxidant streams, e.g., free-oxygen containing gas, optionally in admixture with a temperature moderator, is increased or decreased respectively. The adjusted temperature of each flow rate adjusted stream of oxidant optionally in admixture with a temperature moderator is an inverse function of its adjusted flow rate. This may be also expressed as some percentage of the design flow rate for each adjusted oxidant stream optionally in admixture with a temperature moderator. This percentage may fall, for example within the range of about 18 to 225%, such as about 25 to 140% of the design flow rate for each adjusted oxidant stream optionally in admixture with a temperature moderator. When temperatures are expressed as absolute temperatures (Rankine or Kelvin), the adjusted temperature of each adjusted stream of oxidant optionally in admixture with a temperature moderator may be for example within the range of about 44 to 225%, such as about 60 to 135% of the design temperature. By definition, the design temperature is the temperature of each stream of oxidant optionally in admixture with a temperature moderator for which the burner was originally sized to handle.

The temperature adjustments may be made by heating or cooling each stream of free-oxygen containing gas optionally in admixture with a temperature moderator over a temperature in the range of about 32°-1500° F., such as about 50°-800° F., say about 80°-350° F. for high purity oxygen optionally in admixture with a temperature moderator, and such as about 50°-1350° F., say about 650°-1200° F. for oxygen enriched air optionally in admixture with a temperature moderator.

DESCRIPTION OF THE INVENTION

The present invention pertains to an improved method for operating a partial oxidation gas generator for the production of synthesis gas, reducing gas, or fuel gas that is responsive to load changes by the consumer without impairing performance.

For example, this method may be used in the production of fuel gas for burning in a gas turbine driven electric generator, and in this use it can provide automatic load following of the gasification plant in response to the electric powr generation demand.

In the process, a hot effluent gas stream is made by the partial oxidation of a fuel feedstream comprising a liquid hydrocarbonaceous fuel optionally in admixture with a temperature moderator. Preferably, the reaction takes place without a catalyst. By definition, liquid hydrocarbonaceous fuel may also comprise oxygen-containing liquid hydrocarbonaceous fuels and pumpable slurries of solid carbonaceous fuels in a liquid carrier. The oxidant feedstream comprises a free-oxygen containing gas and may be optionally mixed with a temperature moderator. A separate feedstream of temperature moderator may be optionally present.

The feedstreams are passed through feed lines connected to a burner located at the top of the gas generator. The flow rate for liquid hydrocarbonaceous fuels and slurries of solid carbonaceous fuels may be controlled by a flow rate transmitter, flow recorder-controller or a system control means, and a positive displacement pump equipped with a speed control. In one embodiment, the signals from the flow rate transmitters are provided to a computerized system control means which automatically determines the necessary flow rate adjustments to provide the demand flow rate for the effluent gas stream and provides a corresponding adjustment signal to an automatic control valve in each feed line and to a speed control for the positive displacement pump for liquid fuels and slurries of solid carbonaceous fuel.

The gas generator is a vertical cylindrical steel pressure vessel lined on the inside with a thermal refractory material. A typical partial oxidation synthesis gas generator is shown in co-assigned U.S. Pat. No. 2,818,326 and U.S. Pat. No. 3,544,291 which are incorporated herein by reference. The raw product gas with entrained soot, slag, or other particulate matter passes through an outlet throat in the bottom of the gas generator before entering a gas cooling and scrubbing zone. A burner is located in the top of the gas generator along the central vertical axis for introducing the feedstreams. Suitable burners include the tip-atomizing types such as shown in co-assigned U.S. Pat. Nos. 2,928,460; 3,847,564; 3,874,592; the pre-mix types such as shown in coassigned U.S. Pat. Nos. 3,874,592; 4,351,645; and 4,364,744, and combinations thereof. These U.S. patents are incorporated herein by reference.

In the tip-atomizing burner, impact between the feedstream of free-oxygen containing gas optionally in admixture with a temperature moderator and the feedstream of fuel optionally in admixture with a temperature moderator takes place at the tip of the burner. In a pre-mix burner the feedstream of oxidant optionally in admixture with a temperature moderator and fuel feedstream optionally in admixture with a temperature moderator impact and mix with each other upstream from the tip of the burner. However, three-stream burners may combine pre-mix and tip-atomizing features. The tip of the burner is at or close to the downstream extremity of the burner. By the subject process, the velocity of each oxidant stream optionally in admixture with a temperature moderator as well as the velocity of the mixed stream of oxidant, fuel, and temperature moderator if any emerging at the tip of the burner may be held within an acceptable range. An acceptable range being defined as a range in which the performance as characterized by the carbon conversion varies by less than ±4.0%, for example ±2.8%, when the O/C atomic ratio and the temperature moderator/fuel weight ratio are held substantially constant.

There may be one or more e.g., two streams of oxidant optionally in admixture with a temperature moderator passing simultaneously through the burner. For example, a two stream burner such as shown in coassigned U.S. Pat. No. 3,874,592 may comprise a central conduit surrounded by a spaced concentric coaxial conduit thereby providing an annular passage there between. The stream of oxidant optionally in admixture with a temperature moderator may be connected to and pass through the center conduit or the annular passage; and, the fuel stream optionally in admixture with a temperature moderator may be connect to and pass through the remaining passage. In another example, a three-stream burner, such as shown in coassigned U.S. Pat. No. 3,847,564 may comprise a central conduit surrounded by two spaced concentric coaxial conduits that provide intermediate and annular passages there between. Separate streams of oxidant optionally in admixture with a temperature moderator may be connected to and pass through the center conduit and the outer annular passage. The stream of fuel optionally in admixture with a temperature moderator may be connected to and pass through the intermediate passage. In such case, the flow rates and temperatures for one or preferably both of the oxidant streams optionally in admixture with a temperature moderator may be adjusted in accordance with the subject invention. For example, in one embodiment where two separate streams of oxidant optionally in admixture with a temperature moderator may pass through separate passages in a three-stream burner at different flow rates, each oxidant stream optionally in admixture with a temperature moderator is adjusted to a different temperature which is an indirect function of its adjusted flow rate in order to maintain the velocity of each stream of oxidant, optionally in admixture with a temperature moderator at the tip of the burner within an acceptable range. The temperature adjustments to the streams of oxidant optionally in admixture with a temperature moderator may be done sequentially or simultaneously. The velocity of the various feedstreams at the tip of the burner in feet per second may be as follows: liquid hydrocarbonaceous fuels and slurries of solid carbonaceous fuels e.g. ground coal and water about 10–100, such as 20–50; free-oxygen containing gas optionally in admixture with a temperature moderator, about 200-sonic velocity, such as 200–600; and temperature moderator about 55 to sonic velocity.

The term liquid hydrocarbonaceous fuel as used herein is intended to include various liquid hydrocarbon materials, such as liquefied petroleum gas, petroleum distillates and residua, gasoline, naphtha, kerosene, crude petroleum, asphalt, gas oil, residual oil, tar-sand oil, shale oil, oil derived from coal, aromatic hydrocarbons (such as benzene, toluene, and xylene fractions), coal tar, cycle gas oil from fluid-catalytic-cracking operations, furfural extract of coker gas oil, and mixtures thereof. Included within the definition of liquid hydrocarbonaceous fuel are oxygenated hydrocarbonaceous organic materials including carbohydrates, cellulosic materials, aldehydes, organic acids, alcohols, ketones, oxygenated fuel oil, waste liquids and by-products from chemical processes containing oxygenated hydrocarbonaceous organic materials and mixtures thereof.

Also included within the definition of liquid hydrocarbonaceous fuel are pumpable slurries of solid carbonaceous fuels. Pumpable slurries of solid carbonaceous fuels may have a solids content in the range of about 25–80 wt.%, such as 45–75 wt. %, depending on the characteristics of the fuel and the slurrying medium. The slurrying medium may be water, liquid hydrocarbonaceous fuel, or both.

The term solid carbonaceous fuel includes coal, such as anthracite, bituminous, subbituminous; coke from coal; lignite; residue derived from coal liquefaction; oil shale; tar sands; petroleum coke; asphalt; pitch; particulate carbon; soot; concentrated sewer sludge; and mixtures thereof. The solid carbonaceous fuel may be ground to a particulate size so that 100% passes through an ASTM E11-70 Sieve Designation Standard (SDS) 1.4 mm Alternative No. 14, or finer.

The term free-oxygen containing gas, as used herein is intended to include oxygen-enriched air, i.e., from greater than 21 to 95 mole % oxygen, such as about 50 to 75 mole % oxygen, and high purity oxygen, i.e., greater than 95 mole % oxygen (the remainder comprising $N_2$ and rare gases). Free-oxygen containing gas optionally in admixture with a temperature moderator may be introduced into the burner at a temperature in the range of about 32° to 1500° F., depending on its composition. The atomic ratio of free-oxygen in the oxidant to carbon in the feed stock (O/C, atom/atom) is preferably in the range of about 0.6 to 1.5, such as about 0.80 to 1.3. The term oxidant freedstream, as used herein is synonomous with free-oxygen containing gas feedstream.

The use of a temperature moderator in the reaction zone of the gas generator depends in general on the carbon to hydrogen ratio of the feed stock and the oxygen content of the oxidant stream. Suitable temperature moderators include steam, e.g., saturated or superheated, water, $CO_2$-rich gas, liquid $CO_2$, by-product nitrogen from the air separation unit used to produce substantially pure oxygen, and mixtures of the aforesaid temperature moderators. The temperature moderator may be introduced into the gas generator in admixture with either the liquid hydrocarbonaceous fuel feed, the free-oxygen containing stream, or both. Alternatively, the temperature moderator may be introduced into the reaction zone of the gas generator by way of a separate conduit leading to the fuel burner. Cooled effluent gas from the gas generator or cooled effluent gas from water-gas shift converter may be used as a temperature moderator with liquid hydrocarbonaceous fuels. When $H_2O$ is introduced into the gas generator either as a temperature moderator, a slurrying medium, or both, the weight ratio of $H_2O$ to the liquid hydrocarbonaceous fuel or solid carbonaceous fuel is in the range of about 0.2 to 5.0 and preferably in the range of about 0.3 to 1.0. These ranges are applicable to the other temperature moderators.

The relative proportions of hydrocarbonaceous fuel or solid carbonaceous fuel, water or other temperature moderator, and oxygen in the feed streams to the gas generator are carefully regulated to convert a substantial portion of the carbon in the fuel fed to the partial oxidation gas generator, e.g. about 70 to 100 wt. %, such as about 90 to 99 wt. %, of the carbon to carbon oxides, e.g., CO and $CO_2$, and to maintain an autogenous reaction zone temperature in the range of about 1700° to 3000° F., such as about 2350° to 2900° F. The pressure in the reaction zone is in the range of about 5 to 250 atmospheres, such as about 10 to 200 atmospheres. The time in the reaction zone of the partial oxidation gas generator in seconds is in the range of about 0.5 to 20, such as normally about 1.0 to 5.

The effluent gas stream leaving the partial oxidation gas generator has the following composition in mole % depending on the amount and composition of the feedstreams: $H_2$ 8.0 to 60.0, CO 8.0 to 70.0, $CO_2$ 1.0 to 50.0, $H_2O$ 2.0 to 75.0, $CH_4$ 0.0 to 30.0, $H_2S$ 0.0 to 2.0, COS 0.0 to 1.0, $N_2$ 0.0 to 80.0, and A 0.0 to 2.0. Entrained in the effluent gas stream is about 0.5 to 30 wt. %, such as about 1 to 10 wt. % of particulate carbon (basis weight of carbon in the feed to the gas generator).

The effluent gas stream leaving the reaction zone of the noncatalytic partial oxidation gas generator at a temperature in the range of about 1700° F. to 3000° F. may be either (1) quench cooled and scrubbed with water, (2) cooled in a gas cooler and then scrubbed with water, or both (1) and (2). Gaseous impurities may be optionally removed by conventional gas purification procedures. The product gas stream may be used as synthesis gas, reducing gas, or fuel gas.

In the operation of the subject process, a change in demand for example in the chemical being synthesized in a chemical plant, or for the metal being produced in a reducing furnace, or in the demand for power being generated causes a corresponding change in demand to the associated gasification unit for product synthesis gas, reducing gas, or fuel gas, respectively. If the demand is for a reduced rate of product gas, the flow rates of the fuel, temperature moderator if any, and at least one of the feedstreams of oxidant optionally in admixture with a temperature moderator to the burner are adjusted down in order to turn down the output of raw product gas from the gas generator. Alternatively, if the demand is for an increased rate of product gas, the flow rates of the feedstreams to the burner are adjusted up in order to turn up the output of raw product gas from a gas generator. The adjusted flow rates are predetermined so that a specified output of raw product gas is obtained from the gas generator while the O/C atomic ratio and the temperature moderator/fuel weight ratio in the reaction zone are maintained substantially constant.

Flow rate and temperature adjustments to the feedstreams to the burner may be made manually or by computer. Conventional heat and weight balances and thermodynamic relations may be used to calculate the flow rate adjustments for all of the feedstreams and the corresponding temperature adjustment for each stream of oxidant optionally in admixture with the temperature moderator. Alternatively, an equation may be derived from actual test data relating the adjusted absolute temperature of each specific flow rate adjusted feedstream of oxidant optionally in admixture with the temperature moderator and expressed as a percent of the design temperature, as an inverse function of the adjusted flow rate for each specific flow rate adjusted oxidant stream optionally in admixture with a temperature moderator. Optionally, the adjusted flow rate may be expressed as a percent of the design flow rate.

The flow rate adjustments for all of the streams may be made simultaneously. However, in one embodiment the flow rates are adjusted so as to maintain the O/C atomic ratio during the changes up to 0.05 lower than during steady state operations. In the case of turn down the reduction in the flow rate of an oxidant stream e.g., the free-oxygen containing gas stream optionally in admixture with a temperature moderator is begun before the reduction of the flow rate of the fuel stream optionally in admixture with temperature moderator and the separate feedstream of temperature moderator, if any. By appropriate selection of the time interval between the beginnings of the two adjustments and the relative rates, the O/C atomic ratio is allowed to decrease by up to 0.05 during the transient period as compared to the substantially constant value maintained during steady state. Conversely, in turn up the increase in the flow rates of the fuel feedstream optionally in admixture with temperature moderator and any separate feedstream of temperature moderator are begun before the increase in the flow rate of the feedstream of oxidant optionally in a admixture with temperature moderator. Further, the increases are made in such a fashion that the O/C atomic ratio is allowed to decrease by up to 0.05 during the transient—as was specified for the turn down case.

When the fuel feedstream to the partial oxidation gas generator comprises a liquid hydrocarbonaceous fuel optionally in admixture with temperature moderator or a slurry of solid carbonaceous fuel, flow rate adjustment may be made by a manual or computer operated speed control that may be associated with a positive displacement pump. The temperature of at least one of the oxidant streams optionally in admixture with a temperature moderator in the system is also adjusted in the subject process to a predetermined value. A three-stream burner may be turned up or down according to the subject invention by adjusting the flow rate and temperature of the stream of oxidant optionally in admixture with a temperature moderator flowing in the central conduit and/or in the outer annular passage. Further, the total free-oxygen containing gas optionally in admixture with a temperature moderator feed to the burner may comprise at least one feedstream of high purity oxygen and at least one feedstream of oxygen-enriched air. Each separate stream of free-oxygen containing gas optionally in admixture with a temperature moderator flowing simultaneously through the burner may be adjusted to the same temperature or to a different temperature than the other stream(s) of free-oxygen containing gas optionally in admixture with a temperature moderator. The adjusted temperature for each adjusted stream of free-oxygen containing gas optionally in admixture with a temperature moderator is indirectly related to its adjusted flow rate. The temperature adjustment may be made after all of the flow rate adjustments are completed and the system is stabilized. However, alternatively the temperature and all of the flow rate adjustments may be made simultaneously.

Advantageously, in the subject process which includes the step of adjusting the temperature of at least one feedstream of free-oxygen containing gas optionally in admixture with a temperature moderator to the burner down or up to a value which is an indirect function of its adjusted flow rate, it was unexpectedly found that changes in the performance of the gasifier as indicated by such measurements as the extent of carbon conversion to gas and the relative consumptions of oxygen and fuel are minimized. Further, the velocity of each adjusted stream of free-oxygen containing gas optionally in admixture with a temperature moderator or the velocity of mixtures of fuel, oxidant, and temperature moderator departing at the tip of the burner remain within acceptable limits and changes in process efficiency and pressure drop across the burner are minimized. Ordinarily, a reduction in flow rate for a feedstream of oxidant optionally in admixture with a temperature moderator to the burner would result in a reduction in burner tip velocity for the adjusted stream of oxidant optionally in admixture with a temperature moderator, or the feedstream mixtures of fuel, oxidant, and temperature moderator. The substantial loss of operating efficiency which would ordinarily result when these changes are significant is avoided by the subject invention.

The temperature adjustment may be made by preheating or precooling at least one stream, and preferably all of the streams of oxidant optionally in admixture with a temperature moderator. Preferably, the heating or cooling takes place in a gas heater or gas cooler, respectively prior to passage of the gas streams through the burner. For example, prior to being mixed together the stream of temperature moderator, if any, and at least one stream of oxidant optionally in admixture with a temperature moderator are heated separately to the same or different predetermined temperatures to increase their temperatures when the output of effluent gas from the gas generator is decreased, and cooled separately to the same or different predetermined temperatures to decrease their temperatures when the output of effluent gas from the gas generator is increased. At least a portion of said heated or cooled streams are then mixed together. Similarly, air may be heated or cooled and then mixed with an oxygen stream optionally in admixture with a temperature moderator in order to respectively increase or decrease the temperature of the oxidant stream optionally in admixture with a temperature moderator. Saturated or superheated steam may be mixed with at least one stream of free-oxygen containing gas optionally in admixture with a temperature moderator as a means for increasing the temperature of that stream of oxidant optionally in admixture with a temperature moderator when the output of effluent gas from the reaction zone is decreased.

One embodiment of the invention relates to a computerized control system for controlling the operation of a partial oxidation gas generator. In this system a change in product gas demand by a user located downstream from the gas generator will provide a signal to a system computer control means which also receives input signals corresponding to the flow rates for each of the feedstreams connected to the burner in the gas generator. Input signals corresponding to the temperature of each gaseous oxidant stream are also introduced into the system computer control means. The system control means then determines the amount of adjustment to the flow rates for the feedstream fuel optionally in admixture with a temperature moderator, separate feedstream of temperature moderator if any, and at least one of the feedstreams of oxidant optionally in admixture with a temperature moderator to the burner in order to produce product gas at the new demand rate while maintaining the oxygen/carbon atomic ratio and the temperature moderator/fuel weight ratio in the reaction zone substantially constant. Responsive to said flow rate determinations, a corresponding adjustment signal is provided by the system control means to each flow control unit in each feedline to the burner. The system control means then automatically computes the desired or adjusted temperature for at least one stream of oxidant optionally in admixture with a temperature moderator that is required to maintain within an acceptable range the burner tip velocity of said oxidant stream optionally in admixture with a temperature moderator and/or any mixed stream comprising fuel, temperature moderator if any, and oxidant passing through the orifice at the tip of the burner. The desired or adjusted temperature is an indirect function of the adjusted flow rate for the feedstream of oxidant optionally in admixture with a temperature moderator to the burner. The actual temperature of the oxidant stream optionally in admixture with a temperature moderator entering the burner is determined by a temperature sensor in the line and a corresponding signal is sent to the system control means. The signals corresponding to the actual and desired temperatures of the stream of oxidant optionally in admixture with a temperature moderator are compared in the system control means and responsive to said comparison, a corresponding adjustment signal is provided by said system control means to a temperature control means which controls the operation of a heating or cooling unit through which the stream of oxidant optionally in admixture with a temperature moderator flows. For example, at turndown, the temperature adjustment signal from the system control means is provided to a temperature control means in a gas heating unit consisting of a steam exchanger, bypass line and appropriate control equipment located upstream of the gasifier burner. When the temperature of the oxidant stream optionally in admixture with a temperature moderator is too low a larger portion of the stream of oxidant optionally in admixture with a temperature moderator is directed through the steam exchanger whereupon the mixed mean temperature of the oxidant optionally in admixture with a temperature moderator increases to the required desired temperature. Conversely at turn up of the gasifier, a larger portion of the stream of oxidant optionally in admixture with a temperature moderator may be directed to bypass the steam exchanger and thereby decrease the temperature of the stream of oxidant optionally in admixture with a temperature moderator to the required desired temperature. As an alternative, a similar arrangement could be used in which the exchanger is a gas cooler rather than a steam heat exchanger. In such case, for turn up larger portions of the stream of oxidant optionally in admixture with a temperature moderator would be directed through the cooler to provide the stream of oxidant optionally in admixture with a temperature moderator at the required lower temperature. Whereas, for turn down the stream of oxidant optionally in admixture with a temperature moderator would be directed in larger porportions to bypass the cooler leaving the stream of oxidant optionally in admixture with a temperature moderator at higher temperatures.

The temperature of a flow rate adjusted stream of free-oxygen containing gas optionally in admixture with a temperature moderator may be adjusted after, before, or simultaneously with the adjustment of its flow rate. Temperature adjustments may be made by heating or cooling each stream of free-oxygen containing gas optionally in admixture with a temperature moderator to a predetermined temperature within the range of about 32°-1500° F., such as about 50°-800° F., say about 80°-350° F. for high purity oxygen, and such as about 50°-1350° F., say about 650°-1200° F. for oxygen enriched air.

In one embodiment, in addition to the adjustment in the temperature of at least one feedstream of oxidant optionally in admixture with a temperature moderator and in the same direction, the temperature of the feedstream of liquid hydrocarbonaceous fuel optionally in admixture with a temperature moderator, or a slurry feedstream of solid carbonaceous fuel, or the temperature of a separate feedstream of temperature moderating gas if any, or the temperatures of both the fuel and the temperature moderator feedstreams may be also and preferably simultaneously adjusted to predetermined values which are indirect functions of their adjusted flow rates. Thus, the temperature of the fuel feedstream may be adjusted to a value within the range of about 32° to 950° F., such as about 80° to 350° F.; and the temperature of the feedstream of temperature moderator may be adjusted to a value within the range of about 32° to 1500° F., such as about 50° to 800° F. Conventional heaters, coolers, heat exchangers, or combinations thereof may be used for adjusting the temperature of the feedstreams and may be located upstream from the burner.

EXAMPLE

The following example illustrates a preferred embodiment of the process of this invention and should not be construed as limiting the scope of the invention. Run No. 1 describes the operation of the gas generator under design conditions. In Run No. 2, the flow rates for the feedstreams are reduced to 37% of design with no change in temperature of the oxygen stream. In Run No. 3, the flow rates are reduced to 34% of design and in addition the temperature of the oxygen stream is increased. Run No. 3 illustrates the subject invention. Runs Nos. 1 and 2 are included for comparative purposes only.

RUN NO. 1

A partial oxidation gas generating system is designed to produce 2.703 million standard cubic feet (SCF measured at 60° F., 14.7 psia) of fuel gas per hour. The fuel gas is burned in a gas turbine that powers an electric generator. The fuel to the gas generator comprises 148786 lbs. per hour of a pumpable slurry comprising 33.5 wt. % water and 66.5 wt. % coal with an Ultimate Analysis in weight percent as follows: C 65.86, H 4.68, N 1.38, S, 3.82, O 8.69, and an ash content of 15.57 weight %. The feed slurry is at a temperature of 140° F.

The coal-water feed slurry is passed through a feed line which connects with an inlet to the intermediate passage of a three-stream burner, such as shown in coassigned U.S. Pat. No. 3,847,564. The burner is located in the upper central inlet of a refractory lined noncatalytic free-flow partial oxidation gas generator. Simultaneously, a stream of 83,584 lbs. per hour of substantially pure oxygen i.e. 98.0 mole % $O_2$ at a temperature of 80° F. is passed through two separate feedlines with appropriate control means, one which connects with the inlet to the central passage of the burner and the other which connects with the outer annular passage of the burner. An atomized mixture of the two feed streams is reacted by partial oxidation in the reaction zone of the gas generator at a temperature of 2465° F., a pressure of 600 psig, of O/C atomic ratio of 0.96. A stream of hot raw fuel gas leaves the reaction zone through an outlet throat located at the bottom of the reaction zone along its central longitudinal axis. The gas composition in mole % (dry basis) follows: $H_2$ 35.90, CO 46.67, $CO_2$ 15.38, N+A 0.66, $CH_4$ 0.01, $H_2S$ 1.30 and COS 0.08. About 4384 lbs. per hour of unreacted carbon plus ash and 12324 lbs. per hour of slag are entrained in the raw synthesis gas. The hot raw gas stream is quench cooled with water. After cooling, the gas stream is scrubbed with water in a conventional gas scrubber to produce a product stream of cooled and clean fuel gas.

RUN NO. 2

In Run No. 2, the system described in Run No. 1 is turned down to reduce the output of $H_2$+CO in the product gas by 33%. The rates of flow of all of the feedstreams to the burner are reduced to 37% of the design flow rates to produce this quantity of product. The temperature of the feedstreams, the pressure in the gas generator and the $H_2O$/fuel wt. ratio remain the same as that for Run No. 1. The velocity of the stream of pure oxygen at the tip of the burner drops off to approximately 37% of the design velocity.

RUN NO. 3

In Run No. 3, the system described in Run No. 1 is turned down to reduce the output of $H_2$+CO in the product gas to 33% and the stream of pure oxygen is preheated in a gas heated located upstream from the burner to a temperature of 350° F. The velocity of the stream of pure oxygen at the tip of the burner is thereby approximately 50% of the design velocity, minimizing the deleterious effects of turn down.

A comparison of the gasification performance efficiency for Runs 1 to 3 is shown in Table I, which follows. The performance efficiency for the three runs is represented by the extent of carbon conversion to gaseous products, Specific Oxygen Consumption, SOC, (SCF of Oxygen Consumed/MSCF of $H_2$+CO produced) and Cold Gas Efficiency, CGE, (100 times the Higher Heating Value of the $H_2$+CO produced/-Higher Heating Value for the hydrocarbonaceous fuel fed to gasifier).

The improvements of the subject process are readily discernible from the data shown in Table I for the various runs. For example, in Run No. 2 the temperature of the oxygen stream is the same as that in Run No. 1, but the throughput is reduced, and gasification performance falls off with a reduction in the rate of $H_2+CO$ produced. The extent of carbon conversion to gaseous products and the cold gas efficiency in Run No. 2 are reduced while the specific oxygen consumption is increased in comparison with the performance of Run No. 1. In contrast, in Run No. 3, by increasing the temperature of the oxygen stream to about 150% of the design temperature (expressed as Rankine and Kelvin) of Run No. 1, the drop in velocity of the oxygen stream at the tip of the burner is reduced and the change in gasification performance is minimized even though the rate of $H_2+CO$ produced is 33% of the design rate in Run No. 1.

Other modifications and variations of the invention as hereinbefore set forth may be made without departing from the spirit and scope thereof, and therefore only such limitations should be imposed on the invention as are indicated in the appended claims.

TABLE I

| | GAS GENERATOR OPERATION | | | | | | GASIFICATION PERFORMANCE | | |
|---|---|---|---|---|---|---|---|---|---|
| Run No. | Feed Flow Rate % of Design | Temp. of Oxygen °F. | Velocity of Oxygen at Tip of Burner % of Design | O/C Atomic Ratio | Slurry Concen. Wt. % Solids | Product Gas $H_2$ + CO Rate % of Design | Carbon Conversion Wt. % | SOC SCF $O_2$/ MSCF $H_2$ + CO | CGE % |
| 1 | 100 | 80 | 100 | 0.96 | 66.5 | 100 | 98 | 368 | 74 |
| 2 | 37 | 80 | 37 | 0.96 | 66.5 | 33 | 92 | 406 | 67 |
| *3 | 34 | 350 | 50 | 0.96 | 66.5 | 33 | 96 | 380 | 71 |

*Only Run No. 3 represents the subject process.
Run No.'s 1 and 2 are included for comparison purposes.

I claim:

1. In a partial oxidation process for the production of a raw effluent stream of synthesis gas, reducing gas, or fuel gas in a free-flow partial, oxidation gas generator wherein a plurality of feedstreams comprising a liquid hydrocarbonaceous fuel optionally in admixture with a temperature moderator, or a slurry of solid carbonaceous fuel, at least one feedstream comprising a free-oxygen containing gas optionally in admixture with a temperature moderator, and with or without a separate feedstream of temperature moderator are passed through feed lines provided with flow control means and then through a multi-passage burner which discharges into the reaction zone of said free-flow partial oxidation gas generator; the improvement for adjusting the flow rates for the separate feedstreams to the burner a predetermined amount to turn-down or turn-up the output of said raw effluent gas stream comprising: adjusting the flow rate down at turn-down or up at turn-up a predetermined amount for the fuel feedstream optionally in admixture with a temperature moderator, the separate stream of temperature moderator, if any, and at least one feedstream of free-oxygen containing gas optionally in admixture with a temperature moderator to obtain a decreased output of effluent gas at turn-down or an increased output of effluent gas at turn-up while maintaining the O/C atomic ratio and the temperature moderator/fuel weight ratio in the reaction zone substantially constant; adjusting the temperature of at least one feedstream of free-oxygen containing gas optionally in admixture with a temperature moderator to a predetermined value which is an indirect function of its adjusted flow rate and which is within the temperature range of about 32° F.–1500° F.; wherein the flow rate adjusting comprises reducing at turn-down or alternatively increasing at turn-up the flow rates for the feedstreams simultaneously or in sequence and at turn-down the flow rate reduction for at least one feedstream of free-oxygen containing gas optionally in admixture with a temperature moderator being started first followed by the reduction of the flow rate for the fuel stream optionally in admixture with a temperature moderator, and the flow rate for the temperature moderator stream if any; or where alternatively at turn-up the flow rate adjusting comprises increasing the flow rates of the feedstreams in sequence to predetermined levels by first starting to increase the flow rate of the fuel stream optionally in admixture with a temperature moderator, and the flow rate for the temperature moderator stream if any, and then raising the flow rate of feedstream of free-oxygen containing gas optionally in admixture with a temperature moderator; wherein said flow rates changes are carried out so that the O/C atomic ratio for the feeds is decreased by up to 0.05 during the transient period, and the temperature of at least one feedstream of free-oxygen containing gas optionally in admixture with a temperature moderator is increased to a predetermined value when the flow rate is reduced and decreased to a predetermined value when the flow rate is increased; and wherein the change in burner tip velocity remains within an acceptable range for each feedstream of temperature adjusted free-oxygen containing gas optionally in admixture with a temperature moderator and/or any mixed stream comprising fuel, temperature moderator, and temperature adjusted free-oxygen containing gas so that the carbon conversion to gas varies by less than ±4.0 weight %.

2. The process of claim 1 where each of said feedstreams is adjusted to a value in the range of from about 18 to 225% of the design flow rate for which the burner was originally sized to handle; and each feedstream of free-oxygen containing gas optionally in admixture with a temperature moderator that is adjusted to a temperature in the range from about 44 to 225% of the design temperature for which the burner was originally sized to handle; and wherein the change in pressure drop across the burner is minimized.

3. The process of claim 1 wherein the flow rates for the feedstreams of liquid hydrocarbonaceous fuel optionally in admixture with a temperature moderator, or a slurry of solid carbonaceous fuel, at least one feedstream of free-oxygen containing gas optionally in admixture with a temperature moderator, and the separate stream of temperature moderator, if any are adjusted to a value within the range of about 18 to 225% of its design flow rate.

4. The process of claim 1 provided with the step of increasing the temperature of each feedstream of free-oxygen containing gas optionally in admixture with a temperature moderator to the burner when the output of product gas is decreased, and reducing the temperature of each feedstream of free-oxygen containing gas optionally in admixture with a temperature moderator to the burner when the output of product gas is increased.

5. The process of claim 1 wherein the temperature of each feedstream of free-oxygen containing gas optionally in admixture with a temperature moderator is adjusted either after, before, or simultaneously with the adjustment of its flow rate.

6. The process of claim 1 wherein the fuel feedstream comprises a liquid hydrocarbonaceous fuel optionally in admixture with a temperature moderator, or a slurry of solid carbonaceous fuel, and the flow rate adjustment of the fuel feedstream is done with a manually or automatically operated speed control for a pump.

7. The process of claim 1 provided with the step of adjusting the temperature by passing each feedstream of free-oxygen containing gas optionally in admixture with a temperature moderator through a gas heating or gas cooling system.

8. The process of claim 1 in which said liquid hydrocarbonaceous fuel is a liquid hydrocarbon selected from the group consisting of liquefied petroleum gas, petroleum distillates and residua, gasoline, naphtha, kerosene, crude petroleum, asphalt, gas oil, residual oil, tar-sand oil, shale oil, oil derived from coal, aromatic hydrocarbons (such as benzene, toluene, xylene fractions), coal tar, cycle gas oil from fluid-catalytic-cracking operations, furfural extract of coker gas oil, and mixtures thereof.

9. The process of claim 1 in which said liquid hydrocarbonaceous fuel is a pumpable slurry of a solid carbonaceous fuel in a liquid carrier from the group consisting of water, liquid hydrocarbon fuel, and mixtures thereof.

10. The process of claim 9 in which said solid carbonaceous fuel is selected from the group consisting of coal such as anthracite, bituminous, subbituminous; coke from coal; lignite; residue derived from coal liquefaction; oil shale; tar sands; petroleum coke; asphalt; pitch; particulate carbon; soot; concentrated sewer sludge; and mixtures thereof.

11. The process of claim 1 in which said liquid hydrocarbonaceous fuel is an oxygenated hydrocarbonaceous organic material from the group consisting of carbohydrates, cellulosic materials, aldehydes, organic acids, alcohols, ketones, oxygenated fuel oil, waste liquids and by-products from chemical process containing oxygenated hydrocarbonaceous organic materials, and mixtures thereof.

12. The process of claim 1 in which said free-oxygen containing gas is selected from the group consisting of oxygen-enriched-air, i.e. greater than 21 to 95 mole % $O_2$, and substantially pure oxygen, i.e. greater than about 95 mole % oxygen.

13. The process of claim 1 wherein two separate feedstreams of free-oxygen containing gas optionally in admixture with a temperature moderator pass through separate passages in a three-stream burner at different flow rates, and each feedstream of free-oxygen containing gas optionally in admixture with a temperature moderator is adjusted to a different temperature which is an indirect function of its adjusted flow rate.

14. The process in claim 1 wherein at least one feedstream of free-oxygen containing gas optionally in admixture with a temperature moderator is heated to increase its temperature when the output of effluent gas is decreased, and cooled to decrease its temperature when the output of effluent gas is increased.

15. The process of claim 1 wherein the temperature moderator feedstream and at least one feedstream of free-oxygen containing gas optionally in admixture with a temperature moderator are heated separately to increase their temperatures when the output of effluent gas is decreased, and cooled separately to decrease their temperatures when the output of effluent gas is increased.

16. The process of claim 15 wherein at least a portion of said heated streams of free-oxygen containing gas optionally in admixture with a temperature moderator and said temperature moderator stream are mixed together.

17. The process of claim 1 wherein the feedstream of temperature moderator and at least one feedstream of free-oxygen containing gas optionally in admixture with a temperature moderator are heated separately to different temperatures to increase their temperatures when the output of effluent gas is decreased; or alternatively cooled separately to different temperatures to decrease their temperatures when the output of effluent gas is increased.

18. The process of claim 1 in which the temperature moderator stream is heated and at least a portion is then mixed with at least one feedstream of free-oxygen containing gas optionally in admixture with a temperature moderator when the output of effluent gas is decreased; or alternatively the temperature moderator stream is cooled and at least a portion is then mixed with at least one feedstream of free-oxygen containing gas optionally in admixture with a temperature moderator as a means of decreasing the temperature of each feed stream of free-oxygen containing gas optionally in admixture with a temperature moderator when the output of effluent gas is increased.

19. The process of claim 1 in which air is heated and is then mixed with free-oxygen containing gas stream optionally in admixture with a temperature moderator to increase the temperature of that stream of free-oxygen containing gas optionally in admixture with a temperature moderator when the output of product gas is decreased, and in which air is cooled and then mixed with a free-oxygen containing gas stream optionally in admixture with a temperature moderator to decrease the temperature of that stream of free-oxygen containing gas optionally in admixture with a temperature moderator when the output of effluent gas is increased.

20. The process of claim 1 in which at least one free-oxygen containing gas stream optionally in admixture with a temperature moderator is mixed with saturated or superheated steam as a means of increasing the temperature of that stream of free-oxygen containing gas optionally in admixture with a temperature moderator when the output of effluent gas from the reaction zone is decreased.

21. The process of claim 1 wherein said temperature moderator is selected from the group consisting of steam, water, $CO_2$-rich gas, liquid $CO_2$, $N_2$, and mixtures thereof.

22. The process of claim 1 wherein said stream of temperature moderator comprises cooled effluent gas from the gas generator, or cooled effluent gas from a water-gas shift converter.

23. The process of claim 1 provided with the adjusting of the temperature of at least one of the following feedstreams to the burner as an indirect function of its adjusted flow rate: liquid hydrocarbonaceous fuel optionally in admixture with a temperature moderator, or a slurry stream of solid carbonaceous fuel; and a separate feedstream of temperature moderator.

24. The process of claim 23 wherein the temperatures of said feedstreams are adjusted by at least one temperature adjusting means located upstream from the burner and selected from the group consisting of heater, cooler, heat exchanger, and combinations thereof.

25. The process of claim 1 wherein each temperature adjusted feedstream of free-oxygen containing gas optionally in admixture with a temperature moderator is adjusted to a temperature in the range of about 50° to 800° F. for high purity oxygen, or to a temperature in the range of about 50° to 1350° F. for oxygen-enriched air.

26. The process of claim 1 wherein the free-oxygen containing gas optionally in admixture with a temperature moderator feed to said burner comprises at least one feedstream of high purity oxygen and at least one feedstream of oxygen-enriched air.

27. The process of claim 26 wherein the separate feedstreams of high purity oxygen and oxygen-enriched air are adjusted to the same or different temperatures which are indirectly related to their adjusted flow rate(s).

28. In a partial oxidation process for the production of a raw effluent stream of synthesis gas, reducing gas, or fuel gas in a free-flow partial oxidation gas generator wherein a plurality of feedstreams comprising a liquid hydrocarbonaceous fuel optionally in admixture with a temperature moderator, or a slurry of solid carbonaceous fuel, at least one feedstream comprising a free-oxygen containing gas optionally in admixture with a temperature moderator, and with or without a separate feedstream of temperature moderator are passed through feed lines provided with flow control means and then through a multi-passage burner which discharges into the reaction zone of said partial oxidation gas generator; the improvement for adjusting the flow rates for the separate feedstreams to the burner a predetermined amount to turn-down or turn-up the output of said raw effluent gas stream comprising: adjusting the flow rate down at turn-down or up at turn-up a predetermined amount for the fuel feedstream optionally in admixture with a temperature moderator, the separate stream of temperature moderator, if any, and at least one feedstream of free-oxygen containing gas optionally in admixture with a temperature moderator to obtain a decreased output of effluent gas at turn-down or an increased output of effluent gas at turn-up while maintaining the O/C atomic ratio and the temperature moderator/fuel weight ratio in the reaction zone substantially constant; adjusting the temperature of at least one feedstream of free-oxygen containing gas optionally in admixture with a temperature moderator to a predetermined value which is an indirect function of its adjusted flow rate and which is within the temperature range of about 32° F.–1500° F.; wherein the flow rate adjusting comprises reducing at turn-down or alternatively increasing at turn-up the flow rates for the feedstreams simultaneously or in sequence and at turn-down the flow rate reduction for at least one feedstream of free-oxygen containing gas optionally in admixture with a temperature moderator being started first followed by the reduction of the flow rate for the fuel stream optionally in admixture with a temperature moderator, and the flow rate for the temperature moderator stream if any; or where alternatively at turn-up the flow rate adjusting comprises increasing the flow rates of the feedstreams in sequence to predetermined levels by first starting to increase the flow rate of the fuel stream optionally in admixture with a temperature moderator, and the flow rate for the temperature moderator stream if any, and then raising the flow rate of feedstream of free-oxygen containing gas optionally in admixture with a temperature moderator; wherein said flow rates changes are carried out so that the O/C atomic ratio for the feeds is decreased by up to 0.05 during the transient period, and the temperature of at least one feedstream of free-oxygen containing gas optionally in admixture with a temperature moderator is increased to a predetermined value when the flow rate is reduced and decreased to a predetermined value when the flow rate is increased; wherein said burner comprises a central conduit surrounded by a spaced concentric coaxial conduit thereby providing an annular passage, and with one feedstream of free-oxygen containing gas optionally in admixture with a temperature moderator being connected to said central conduit or annular passage, and a separate feedstream comprising a liquid hydrocarbonaceous fuel optionally in admixture with a temperature moderator, or a slurry of solid carbonaceous fuel being connected to the remaining conduit or passage; or alternatively said burner comprises a central conduit surrounded by two spaced concentric coaxial conduits that provide intermediate and outer annular passages, and with a separate feedstream of free-oxygen containing gas optionally in admixture with a temperature moderator being connected to said central conduit and outer annular passage respectively, and a separate liquid hydrocarbonaceous fuel feedstream optionally in admixture with a temperature moderator or a slurry of solid carbonaceous fuel being connected to said intermediate annular passage; and wherein the change in burner tip velocity remains within an acceptable range for each feedstream of temperature adjusted free-oxygen containing gas optionally in admixture with a temperature moderator and/or any mixed stream comprising fuel, temperature moderator, and temperature adjusted free-oxygen containing gas so that the carbon conversion to gas varies by less than ±4.0 weight %.

* * * * *